US006984169B2

(12) United States Patent
Chen

(10) Patent No.: US 6,984,169 B2
(45) Date of Patent: Jan. 10, 2006

(54) BI-DIRECTIONAL ROTATION PNEUMATIC GRINDING TOOL

(76) Inventor: Lung-Hui Chen, No. 296-1, Jungshan Rd., Jubei City, Hsinchu (TW)

( * ) Notice: Subject to any disclaimer, the term of this patent is extended or adjusted under 35 U.S.C. 154(b) by 311 days.

(21) Appl. No.: 10/453,520

(22) Filed: Jun. 4, 2003

(65) Prior Publication Data

US 2004/0248505 A1 Dec. 9, 2004

(51) Int. Cl.
*B24B 41/00* (2006.01)

(52) U.S. Cl. ..... 451/340; 451/344; 451/358; 451/359; 451/360

(58) Field of Classification Search ..... 451/340, 451/344, 358, 359, 360
See application file for complete search history.

(56) References Cited

U.S. PATENT DOCUMENTS 4,364,286 A * 12/1982 Ciolli ..... 475/270
4,696,208 A * 9/1987 Lay ..... 81/58
4,889,454 A * 12/1989 Hillestad et al. ..... 408/124

* cited by examiner

*Primary Examiner*—Joseph J. Hail, III
*Assistant Examiner*—Shantese McDonald
(74) *Attorney, Agent, or Firm*—Birch, Stewart, Kolasch & Birch, LLP

(57) ABSTRACT

A bi-directional rotation pneumatic grinding tool for grinding surfaces includes a body which has an operation section and a grasp section. The operation section drives an output shaft to rotate in two directions. The output shaft has positive threads in the interior and reverse threads on the outside and is coupled with a fastening mechanism. The fastening mechanism includes a coupling head which has one end forming a fastening section with reverse threads formed thereon. The front section of the output shaft is coupled with a connection member which has other end forming a latch section with reverse threads formed thereon. The latch section is coupled with an anchor member. A fastener with positive threads runs through the anchor member and engages with the positive threads on the inner wall of the output shaft. The positive threads and the reverse threads of various elements of the fastening mechanism are engageable with each other to allow the pneumatic grinding tool to rotate in a positive direction or a reverse direction according to different requirements without loosening and direct sparks, grinding debris or dusts generated in the grinding processes in a desired direction without polluting environment or hurting people and working pieces.

7 Claims, 3 Drawing Sheets

BI-DIRECTIONAL ROTATION PNEUMATIC GRINDING TOOL

FIELD OF THE INVENTION

The present invention relates to a bi-directional rotation pneumatic grinding tool and particularly to a pneumatic tool capable of rotating in the positive direction or the reverse direction depending on different requirements to direct sparks, grinding debris or dusts generated in the grinding process in a desired direction.

BACKGROUND OF THE INVENTION

There are many types of grinding machines. They mostly rotate in a unidirectional manner at low speed and high torque to process rough surfaces. To suit different grinding surfaces, they can be classified in flat grinding and side grinding by the operation mode. As the grinding machines are designed in many different types, they are widely used in many industries such as iron work, machinery, wood working, molding, automobiles and motorcycles, repairs and maintenance, glass fibers, electronics, and the like. Different sizes of granule of the grinding piece may be selected to perform required operations such as polishing, rust removing, glue removing, grinding, wax polishing, edge trimming, drilling, or the like.

Refer to FIG. 1 for a typical operation section of the conventional unidirectional rotation grinding machine that rotates at low speed and high torque. It includes a fastening mechanism. As shown in the drawing, the operation section has an output shaft 6 extending outwards. The output shaft 6 is coupled with a bearing 7 and screws a coupling head 1. The coupling head 1 has a fastening hole 11 and is engaged with a fastener 2. When in use, a grinding piece 4 is sandwiched and anchored between the coupling head 1 and the fastener 2. The output shaft 6 is driven by a driving mechanism to rotate at high speed to drive the grinding piece 4 to rotate in one direction. When the unidirectional grinding machine performs grinding operation, sparks, grinding debris, powders or dusts are inevitably generated. The sparks may spew to the surrounding and cause fire when inflammable goods are around. Dusts produce environmental pollution. The grinding debris scatter around and may cause severe hazards to the health and safety of operators.

Moreover, due to the conventional grinding machines rotate in one direction, when grinding a narrower working piece or corners, the grasp section of the grinding machines is constrained due to design limitation and allows only surface machining to be performed on the working piece. Some corners cannot be machined smoothly by the conventional grinding machines, and operators have to adopt other operating gestures or approaches to do machining operation. Those abnormal operation methods often affect grinding quality and produce defects on the machining surface.

In addition, when the grinding piece 4 rotates at high speed, a greater torque occurs on the exposed section of the output shaft 6. Because of the length of the output shaft 6 or uneven distribution of the torque, the output shaft tends to occur deformation or even damage.

SUMMARY OF THE INVENTION

The primary object of the invention is to resolve the aforesaid disadvantages and overcome the drawbacks of the prior art. The invention includes a connection member to enable the invention to rotate positively or reversely according to different requirements. Thus sparks, grinding debris or dusts generated in the grinding process may be directed in a desired direction to avoid polluting operation environment or hurting people and working pieces.

Another object of the invention is to have the connection member entirely encasing a fastener to achieve even distribution of torque on the fastener and prevent deformation or damage of the fastener caused by uneven distribution of the torque.

In order to achieve the foregoing objects, the bi-directional rotation pneumatic grinding tool of the invention includes a body which has an operation section and a grasp section. The operation section drives an output shaft to rotate in both directions. The output shaft has positive threads formed in the interior and reverse threads formed on the outside. The output shaft also couples with a fastening mechanism. The fastening mechanism includes a coupling head which has one end forming a fastening section with reverse threads formed therein, a connection member screwed on a front section of the output shaft, a latch section located on the other end of the connection member that has reverse threads, an anchor member fastening to the latch section, and a fastener which has positive threads running through the anchor member and engaging with the positive threads formed on the inner wall of the output shaft. By means of the fastening mechanism that has elements of positive and negative threads and may be fastened tightly with one another, the invention can rotate positively or reversely according to different requirements without loosening. And sparks, grinding debris or dusts generated in the grinding process may be directed in a desired direction without polluting the operation environment or hurting people and the working pieces.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
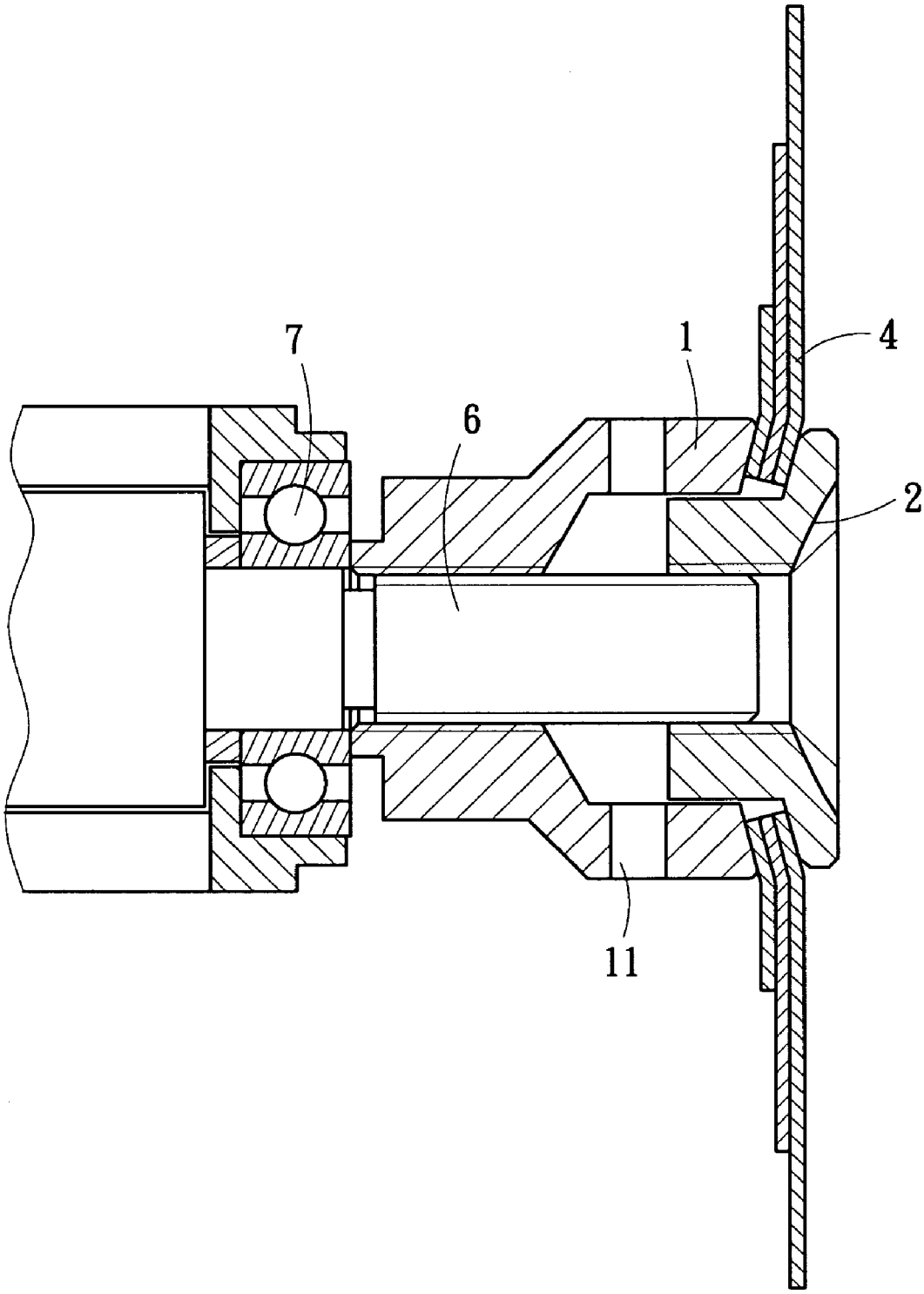
Fig.1 PRIOR ART
FIG. 1 is a sectional view of the fastening mechanism of a conventional pneumatic grinding machine.
Figure 2:
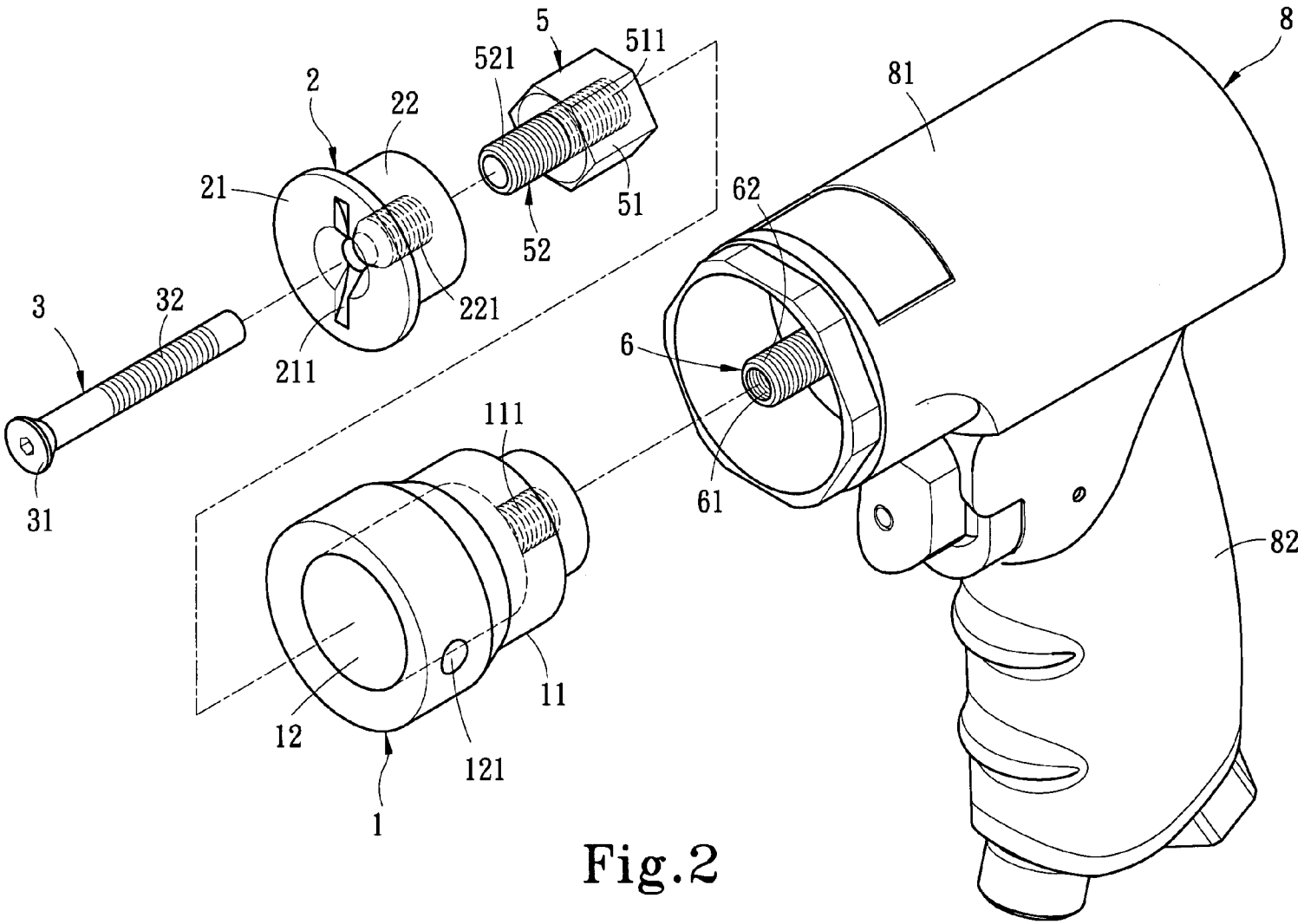
FIG. 2 is an exploded view of the present invention.
Figure 3:
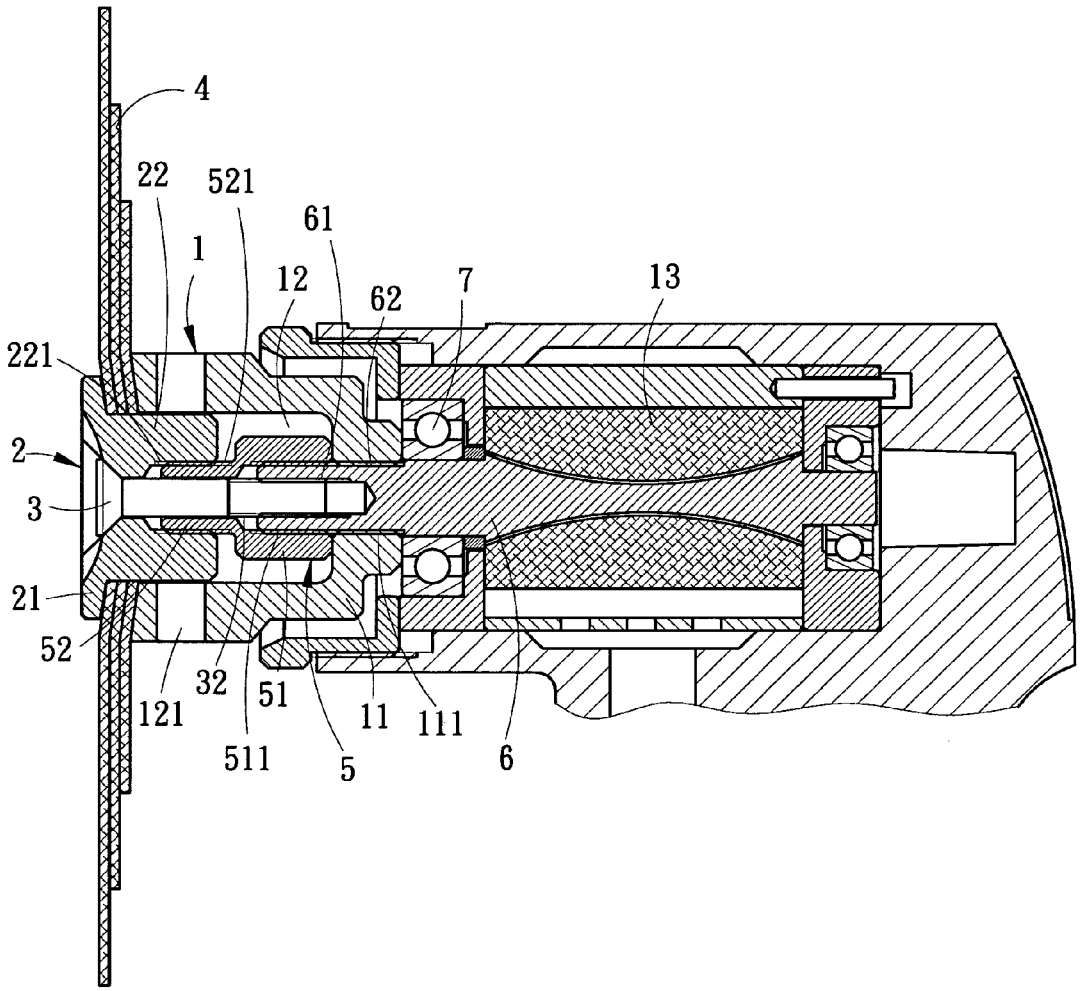
FIG. 3 is a fragmentary sectional view of the present invention.

Please refer to FIGS. 2 and 3 for an exploded and a fragmentary sectional view of the present invention. The bi-directional rotation pneumatic grinding tool of the invention is designed for machining surfaces. It includes a body 8 which has an operation section 81 and a grasp section 82. The operation section 81 has an actuator 13 to drive an output shaft 6 to rotate in both directions. The output shaft 6 further is coupled with a fastening mechanism. The fastening mechanism consists of a coupling head 1, a connection member 5, an anchor member 2 and a fastener 3. The output shaft 6 has an inner wall which has positive threads 61 and an outer wall which has reverse threads 62.

The output shaft 6 also is coupled with a bearing 7 to reduce friction between the output shaft 6 and the fastening mechanism.

The coupling head 1 has two ends communicating with each other. One end is formed in a stepwise manner and has a fastening section 11 with reverse threads 111 formed therein to engage with the reverse threads 62 of the output shaft 6 and to be in contact with the inner perimeter of the bearing 7. The other end of the coupling head 1 forms a connecting section 12 with an anchor hole 121 formed thereon.

The connection member 5 has two ends communicating with each other and is made from a material of a great hardness. It is housed in the coupling head 1 and has one end forming a polygonal latch section 51 which has reverse threads 511 formed therein to couple with the reverse threads 62 on the outer wall of the output shaft 6, and other end forming an engaging section 52 which has reverse threads 521 formed on the outer wall thereof.

The anchor member 2 has two ends communicating with each other. It has a coupling section 22 on one end with reverse threads 221 formed therein to engage with the reverse threads 521 on the outer wall of the engaging section 52 of the connection member 5, and the other end forming a stop section 21 which has a latch trough 211.

The fastener 3 has positive threads 32 and one end forming a bucking section 31. The rear section of the positive threads 32 runs through the anchor member 2 and the front section of the positive threads 32 engage with the positive threads 61 in the output shaft 6. It is entirely encased in the elements of the fastening mechanism.

Referring to FIG. 3, when in use, a grinding piece 4 is sandwiched between the anchor member 2 and the coupling head 1 and is fastened securely by the fastener 3. The output shaft 6 and the grinding piece 4 are driven by the driving mechanism to rotate at high speed. As the latch section 51 of the connection member 5 may be coupled with the reverse threads 62 on the outer wall of the output shaft 6, and the reverse threads 521 on the outer wall of the engaging section 52 of the connection member 5 may be coupled with the reverse threads 221 of the coupling section 22 of the anchor member 2, and the positive threads 32 of the fastener 3 may run through various elements and engage with the positive threads 61 on the inner wall of the output shaft 6, hence when the invention rotates clockwise (positive direction), the reverse threads 221 and 521 of the anchor member 2 and the engaging section 52 of the connection member 5 that have been engaged with each other may be turned loose due to the reverse rotation. But because the positive threads 32 and 61 of the fastener 3 and the output shaft 6 are engaged with each other and positive rotation occurs, they are coupled with each other tightly. On the contrary, when the invention rotates counterclockwise (reverse direction), the fastener 3 and the output shaft 6 rotate in the reverse direction and tend to become loose. However, the anchor member 2 and the engaging section 52 of the connection member 5 are coupled tighter because of the positive rotation. Therefore, by means of the mutual coupling relationship between the positive threads and the reverse threads 111, 221, 32, 511, 521, 61, and 62 on various elements of the fastening mechanism, the invention may rotate positively or reversely without loosening. And sparks, grinding debris and dusts generated in the grinding process may be directed in a desired direction to avoid polluting the environment or hurting people and working pieces.

Moreover, the fastener 3 is encased entirely in the connection member 5. Deformation or damage may be prevented resulting from uneven torque, and operation efficiency may be improved.

In addition, The positive threads and the reverse threads mentioned above may be interchanged according to different user requirements. Namely, the positive threads may be changed to reverse threads while the reverse threads may be changed to positive threads.

What is claimed is:

1. A bi-directional rotation pneumatic grinding tool comprising a body which has an operation section and a grasp section, the operation section having an actuator to drive an output shaft to rotate in two directions, the output shaft having positive threads formed on an inner wall thereof and reverse threads formed on an outer wall, and being coupled with a fastening mechanism, wherein the fastening mechanism includes:

a coupling head which has two ends communicating with each other, one end forming a fastening section which has first reverse threads formed in the interior for fastening to the reverse threads of the output shaft and other end forming a connecting section;

a connection member which has two ends communicating with each other and is located in the coupling head, one end thereof forming a latch section which has second reverse threads formed therein to couple with the reverse threads of the output shaft and other end forming an engaging section which has third reverse threads formed on an outer wall thereof;

an anchor member which has two ends communicating with each other, one end thereof forming a coupling section which has fourth reverse threads to engage with the third reverse threads of the connection member; and a fastener which has positive threads formed thereon to run through the anchor member and engage with the positive threads of the output shaft, the fastener being entirely encased in the fastening mechanism;

wherein the positive threads and the reverse threads are engageable with one other to allow the pneumatic grinding tool to rotate in a positive direction or a reverse direction according to different requirements without loosening and direct sparks, grinding debris or dusts generated in grinding processes in a desired direction without polluting environment or hurting people and working pieces.

2. The bi-directional rotation pneumatic grinding tool of claim 1, wherein the fastening section of the coupling head is formed in a stepwise manner.

3. The bi-directional rotation pneumatic grinding tool of claim 1, wherein the connecting section of the coupling head has an anchor hole.

4. The bi-directional rotation pneumatic grinding tool of claim 1, wherein the latch section of the connection member is polygonal.

5. The bi-directional rotation pneumatic grinding tool of claim 1, wherein the connection member is made from a material of a great hardness.

6. The bi-directional rotation pneumatic grinding tool of claim 1, wherein one end of the anchor member has a stop section which has a latch trough formed thereon.

7. The bi-directional rotation pneumatic grinding tool of claim 1, wherein the fastener has one end forming a bucking section.

* * * * *